United States Patent [19]

McKee

[11] 4,113,337

[45] Sep. 12, 1978

[54] CONNECTOR CONSTRUCTIONS AND MOUNTING MEANS AND HOODS THEREFOR

[75] Inventor: William H. McKee, West Covina, Calif.

[73] Assignee: TRW Inc., Elk Grove Village, Ill.

[21] Appl. No.: 736,895

[22] Filed: Oct. 29, 1976

[51] Int. Cl.[2] ..... H01R 13/54

[52] U.S. Cl. ..... 339/91 R; 339/75 M; 339/126 R; 339/176 M

[58] Field of Search ..... 339/75 M, 91 R, 176 M, 339/176 MP, 103 R, 125 R, 126, 128, 132, 134

[56] References Cited

U.S. PATENT DOCUMENTS

| | | | |
|---|---|---|---|
| 3,409,859 | 11/1968 | Krehbiel | 339/91 R |
| 3,662,321 | 5/1972 | Bury | 339/176 M UX |
| 3,936,129 | 2/1976 | Guy | 339/75 M X |

FOREIGN PATENT DOCUMENTS

| | | | |
|---|---|---|---|
| 720,950 | 11/1965 | Canada | 339/176 MP |
| 6,503,360 | 9/1965 | Netherlands | 339/134 |
| 1,139,028 | 1/1969 | United Kingdom | 339/176 MP |

*Primary Examiner*—Roy Lake
*Assistant Examiner*—E. F. Desmond
*Attorney, Agent, or Firm*—Neuman, Williams, Anderson and Olson

[57] ABSTRACT

Ribbon-type electrical connectors of substantially all plastic insulator construction are disclosed, with cooperative clips for mounting of the connectors on chassis panels or the like without further fastening devices. A hood also is provided which is adapted to readily and detachably interlock with the portions of the connector which are designed to engage the clips.

29 Claims, 23 Drawing Figures

FIG. 1
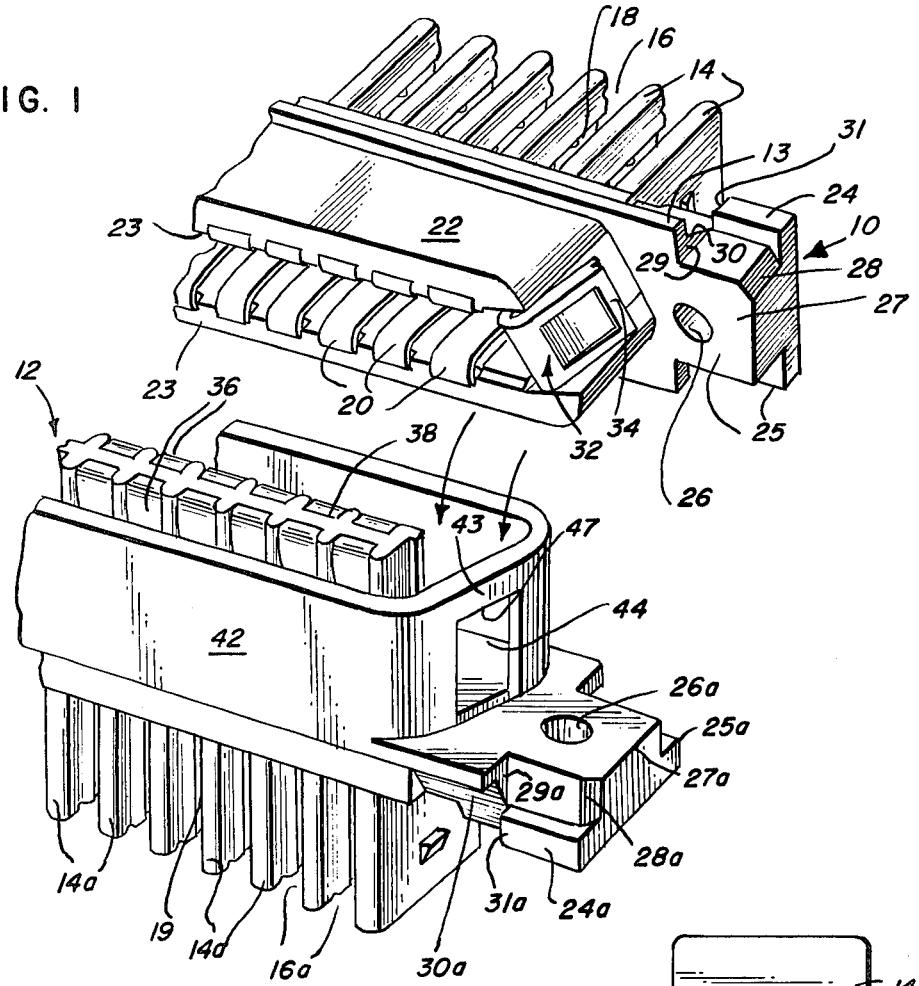
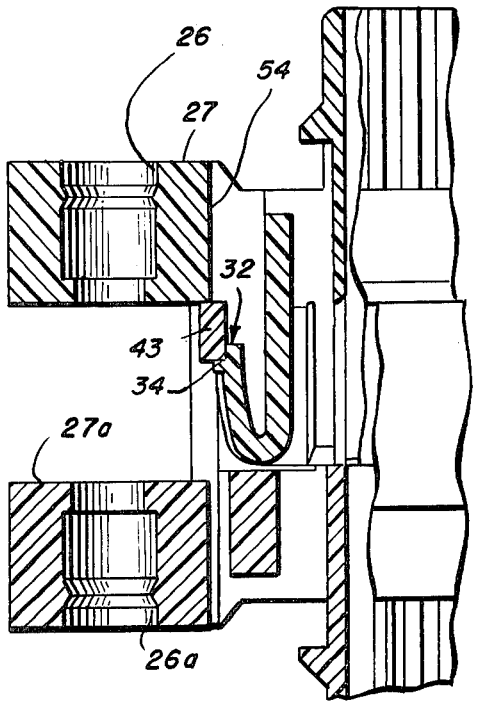
FIG. 3
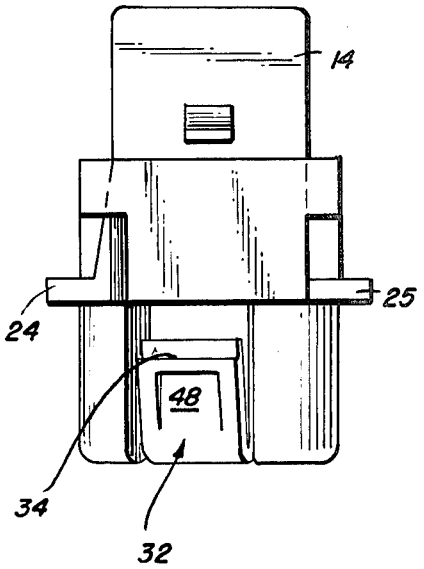
FIG. 2

FIG. 18
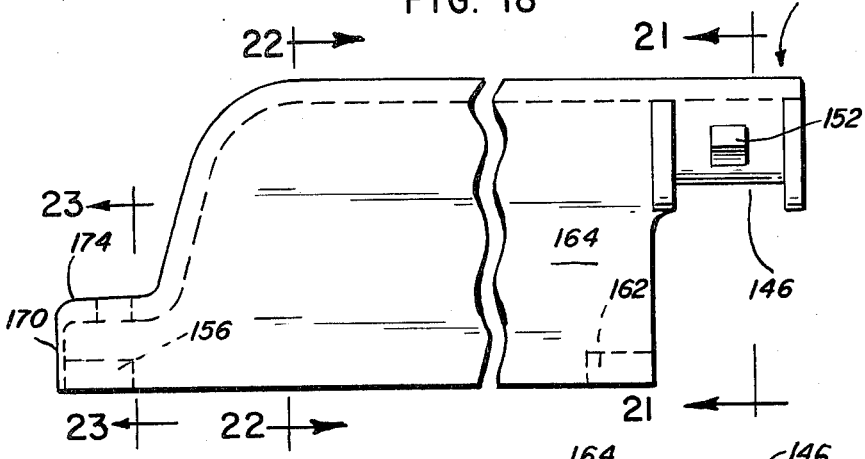
FIG. 20
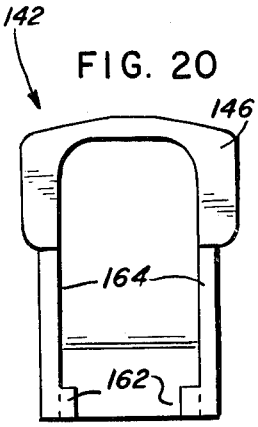
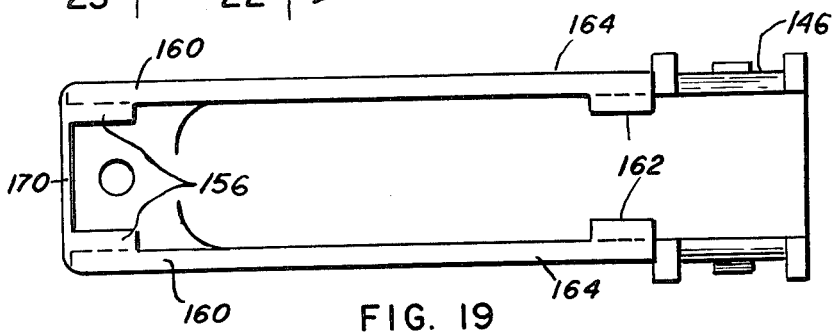
FIG. 19
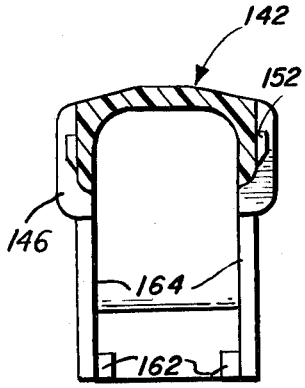
FIG. 21
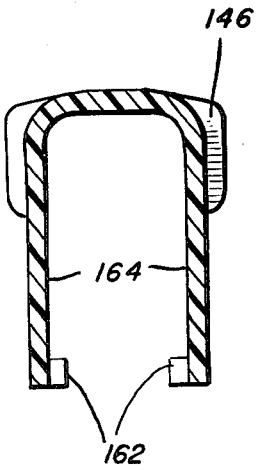
FIG. 22
FIG. 23
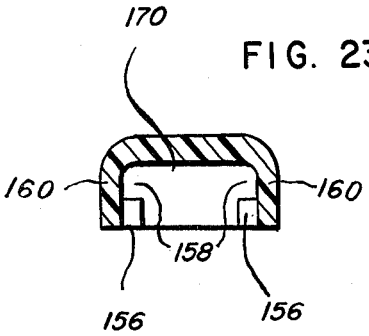

CONNECTOR CONSTRUCTIONS AND MOUNTING MEANS AND HOODS THEREFOR

My copending aaplication Ser. No. 736,942, filed Oct. 29, 1976, pertains to the interconnecting latch arrangement of the connectors disclosed herein as well as to other inter-connector latching means.

This invention relates to means for mounting electrical connectors and for attaching hoods to such connectors. More specifically, this invention relates to means for attaching connectors to panels such as chassis panels, for effecting connector-to-mounting panel interlock and for effecting connector hood engagement.

The connectors hereinafter described are employed in so-called miniature ribbon termination systems or high density systems in which a plurality of wires are terminated in closely adjacent relationship. Included in such connector constructions are those presently manufactured by TRW Inc. of Elk Grove Village, Illinois and referred to as Cinch Ribbon connectors. Such connector constructions may be employed in the termination of wires by either soldering or solderless techniques, an example of the latter being that disclosed in McKee and Witte application Ser. No. 443,678, filed Feb. 19, 1974.

Ribbon connectors of the type referred to herein normally employ a body of electrically insulating plastic which has formed therein a plurality of wire receiving channels in which wires are received and engaged by metallic terminating contact members. The metal contacts extend through the thickness of the plastic body, and have exposed mating portions adapted to engage with mating portions of another connector whereby an electrical connection is established between female and male connectors, or connectors more commonly known as receptacle and plug types, respectively.

The art has previously employed separate securing means, such as screws or the like, for purposes of maintaining connector members in an assembled relationship with a mounting panel or board, and as well as for attaching hoods to such connectors. One such arrangement for mounting a connector on a support chassis is disclosed in Kirby U.S. Pat. No. 3,824,552. In addition to requiring inclusion of the securing devices as part of the product cost, such connectors impose a significant additional cost on the user in the form of the time and effort necessary to apply such securing means.

Steinbach U.S. application Ser. No. 672,643, filed Apr. 1, 1976 discloses a connector receptacle construction which avoids the need for separately applied fasteners. In the Steinbach device the connectors have opposed resilient latch means with projecting prongs which are adapted to engage a receiving opening in a supporting channel or chassis by means of a snap-in action. However, it has been found that such connector constructions are rather weak in holding force, particularly when formed of glass-filled polyester-type plastics which are in wide usage in formation of such connectors. Thus, upon the exertion of a connector removal force, the latch means may yield or fracture. Also, it was found that the specific latch constructions employed required the utilization of intricate and expensive molding techniques. Specifically, a side acting mold was required to form latching detent shoulders.

It is an object of this invention, therefore, to provide improvements in the means for mounting electrical connectors and particularly ribbon-type electrical connectors.

It is an object of this invention to provide improved connector designs of the subject type and cooperative mounting devices which will provide convenient, reliable and secure joining of the connectors to mounting panels or the like.

It is another object of this invention to provide improved connector designs of the subject type which will provide convenient reliable and secure joining of hoods to the connectors.

It is yet another object of this invention to provide a connector mounting clip which may be readily attached to the connectors, such clips having portions assuring desired fixed retention of the connectors without movement in the course of connector use.

It is another object of this invention to provide improved means for mounting a connector member on a chassis at an opening therein and which assure a fixed interlock between the elements engaged while also providing for easy disengagement when it is desired to remove the connector member from its mounting position. The foregoing is effected without the need for separate securing means such as screws, bolts and the like.

It is still a further object of this invention to provide a hood construction which is readily engageable with connector body portions whereby a secure interlock is effected without the need for discrete securing means.

The above and other objects of this invention will become more apparent from the following detailed description and appended claims when read in the light of the accompanying drawings.

In one embodiment of the provided invention connectors are provided having a plurality of wire-receiving channels and terminal contacts disposed therein on one side of the central connector portion, with mating contact portions projecting from the opposite side of said central connector portion. Connector securing means in the form of clips are provided for mounting on cooperative opposed end portions of such connectors. The securing means have formed therein spring tabs adapted to engage connector shoulder portions so as to assure a secure assembly with the connectors without the need for separate fasteners. Depending blade portions of such clips are adapted to effect interlocking engagement with a chassis-opening periphery. Such clips are readily disengageable from the chassis by flexing the blade portions to allow withdrawal of the connector members from the chassis opening.

In a related improvement, other clips are mountable on the periphery of a chassis panel opening and have reverse bend wall portions defining slots which slidably engage the same opposed connector end portions designed for engagement by the first-mentioned clips. A spring clip portion integrally formed with a base disposed between the walls serves to detachably secure such clips to a peripheral portion of a chassis opening.

In the related hood construction, foot portions integrally formed with hood walls function in substantially the same manner as the clip construction last described so as to effect a disengageable interlock with the same opposed connector end portions, as will hereinafter be explained in greater detail.

Latch means such as disclosed in greater detail in my application Ser. No. 736,942, filed Oct. 29, 1976, may be included in a connector receptacle construction made pursuant to the after-described invention. Such latch means are adapted to engage an opening formed in a skirt portion of a connector plug in interlocking engagement as will be hereinafter described in greater detail.

DESCRIPTION OF THE DRAWINGS

FIG. 1 is a fragmentary perspective view illustrating a receptacle version of a connector employing teachings of this invention in the process of being moved into interlocking engagement with a complementary plug version of the connector;

FIG. 2 is an end elevational view of the connector receptacle of FIG. 1;

FIG. 3 is a sectional view illustrating an interlock by the latch of the receptacle of FIG. 1 after the same has interlocked with the plug of FIG. 1;

FIG. 18 is a fragmentary elevational view, partly in section, similar to FIG. 13 of a modified hood construction adapted to engage connector members illustrated in various views of this drawing;

FIG. 19 is a bottom plan view of the hood of FIG. 18;

FIG. 20 is an end elevation view of the hood of FIG. 18;

FIG. 21 is a sectional view taken on line 21—21 of FIG. 18;

FIG. 22 is a sectional view taken on line 22—22 of FIG. 18; and

FIG. 23 is a sectional view taken on line 23—23 of FIG. 18.

In FIG. 1 a female or receptacle connector 10 is illustrated prior to being urged into interlocking engagement with a male or plug connector 12. Connector 10 comprises a central body portion 13 from which extend a plurality of integrally molded barrier portions 14, the barriers defining therebetween wire-receiving channels 16 in which are disposed metal, wire-gripping contacts 18. The wire-gripping portions of elements 18 disposed in the channels 16 are integral with contact mating portions 20 which extend through the central connector portion 14. Mating portions 20 are aligned in series along opposed inner wall portions 23 of the skirt-like body portion 22 of the connector 10.

Figure 4:
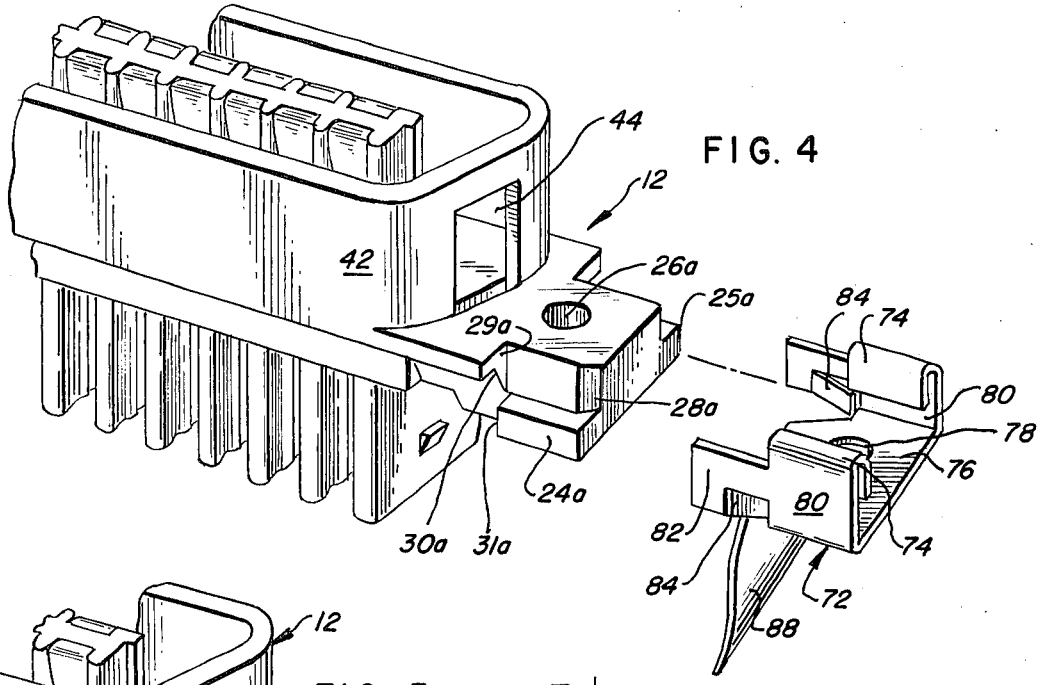
FIG. 4 is a fragmentary, exploded, perspective view illustrating a latch adapted to be maintained in engagement with an end portion of a connector as in FIG. 1 together with an end portion of a connector plug with which such clip member is to be engaged, in accordance with teachings of this invention.

The connectors 10 and 12 have predeterminately formed end portions for interlocking engagement with various cooperatively designed mounting clips and hooks, as will be described below. Each longitudinal end portion of connector 10 is defined by laterally projecting ears or tabs 24 and 25 extending from a thicker central portion 27 through which an aperture 26 is disposed in which a securing means such as a screw or the like may be received. It will be noted that connector portion 27 has a beveled corner 28 on the same side as a sloping ramp portion 30. Ramp 30 defines at an end surface a stop shoulder 29 adjacent ear 24. The innermost end surfaces of the ears 24 and 25 define projecting stop surfaces 31 the function of which will be more clearly seen hereinafter. Beveled ramp surface 30 is adapted to effect a wedging or camming action in a manner which will also hereinafter be made more apparent.

The end portions of the connector 12 are identical with those of connector 10 and bear the same numerals for corresponding parts and the suffix "*a*".

Defining opposed ends of the skirt-like portions 22 of the connector 10 are resilient latch members 32 of substantially J-shaped configuration, see FIG. 3. Each latch has a laterally projecting lip 34 adapted to function as a locking detent.

The mating portions 20 of the contacts 18 shown in FIG. 1 are adapted to be received in slidable engagement with mating contact portions 36 disposed on opposed surface portions of a central projecting barrier 38 of plug connector 12. Thus electrical contacts are established between the wires terminated in the two connectors when intermated.

It will be noted from FIG. 1 that the contact mating portions 36 extend from contact portions 19 disposed within channels 16*a* of the connector 12 defined by barrier portions 14*a*. The contact mating portions 36 of the plug connector 12 together with the central insulating support 38 are centrally disposed of an encompassing skirt 42. The skirt 42 is integrally formed with the connector body and has latch-receiving openings 44 disposed in opposed end portions. The relative dimensions of the connectors 10 and 12 are such that when receptacle 10 and the plug 12 are interconnected into an assembly, skirt-like body portions 22 of connector 10 are snugly received within the inner periphery of skirt 42 of connector 12. Simultaneously, the resilient latches 32 at each end of the connector 10 (only one of which is seen in FIGS. 1 and 3), are biased inwardly as the projecting detents 34 thereof slidably engage inner wall portions of the skirt 42 of the plug 12. The engagement continues until the projecting detents 34 snap beneath lower opening-defining edge portions 47 of the skirt portion 42 of connector 12; edge 47 defines in part latch-receiving opening 44, see FIG. 3.

The structure illustrated in FIGS. 1 and 2 is duplicated at the left end portions of such connectors. It will be noted that the dispositions of the latches 32 are at angles so as to form a generally uniform, trapezoidal configuration with the skirt-like projecting portions 22 which interfit with the corresponding inner periphery of the slightly larger skirt 42 of the connector plug 12. The generally trapezoidal configurations of the connector portions assure proper polarization of the connectors when joined to insure engagement of the mating contact portions in desired relationship.

Separate metal latching elements may be mounted in the connector body in lieu of the integral latches 32, such as in aperture 54, for interlocking two noted connectors, as disclosed further in my aforesaid copending application Ser. No. 736,942, filed Oct. 29, 1976. In addition to being automatically joinable to one another by the afore-described snap locking of the latches in the respective receiving openings, each of the connectors 10 and 12 is adapted for joining to existing connectors which require separate securing devices such as screws or bolts. This is accomplished by maintaining the end portions free of overlying structure and by providing the securement openings 26 and **26*a*** therethrough.

In many instances, it is desirable or necessary to mount either a receptacle or a plug connector directly to a support panel, such as a part of a backboard, a chassis or a wiring panel. The clips 72 and 100 illustrated in FIGS. 4–12 are designed to cooperate with the aforedescribed connectors to conveniently effect such mounting of the connectors.

Referring now to FIG. 4, a mounting clip 72 is illustrated prior to engaging an end portion of a connector which is of the same construction as the connector 12 illustrated in FIGS. 1–3. The clip 72 has opposed reverse bend portions 74 spaced and joined by side walls 80 and an interconnecting clip bottom 76. The bottom 76 has an aperture at 78 adapted to align with connector aperture **26*a* when in the normal assembled position of FIG. 5**.

Extending from clip side wall portions 80 are extensions 82 having inwardly punched therefrom spring tabs 84. The tabs are inwardly disposed so that clip 72 may be mounted on an end portion of connector 12 by slidably inserting the opposed ears **24*a* and 25*a* beneath the terminal ends of the reverse bends 74. Simultaneously, the opposed spring tabs 84 will slidably engage the outer faces of the connector ears 24*a* and 25*a* until the distal ends of the spring tabs snap into engagement with the shoulders 31*a* defining the inner end limits of the opposed ear 24*a* and 25*a***.

Figure 5:
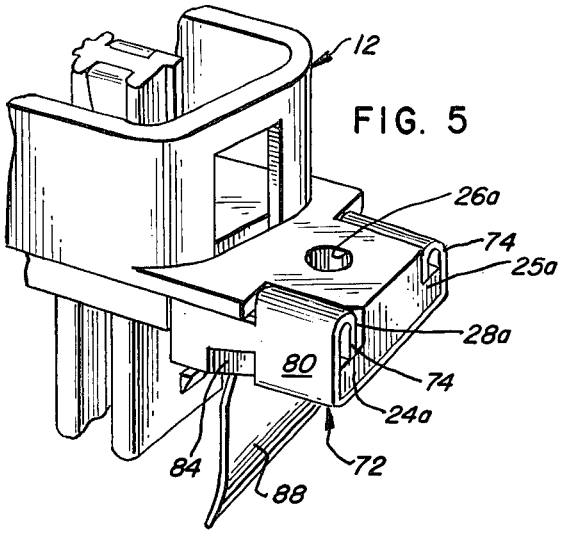
FIG. 5 is a fragmentary elevational view of the elements of FIG. 4 after the same have been assembled.

FIG. 5 illustrates clip 72 in engagement with the right end portion of the plug connector 12. Depending from the inner end of bottom portion 76 of clip 72 is a curved spring blade 88. The blade 88 is adapted to depend below a chassis plate such as plate 94 illustrated in FIG. 7 for purposes of retaining the clip and an interlocked connector to the plate in an assembled relationship, in a manner similar to the clips shown in the aforementioned Kirby U.S. Pat. No. 3,824,552. The distal end of the blade is curved inwardly of the connector as seen at **88*a* in FIG. 7 to facilitate entry into an opening of a panel. Wing edges 89 are bent forward to insure firm engagement with the underside of the adjacent portion of the panel 94**.

Figure 6:
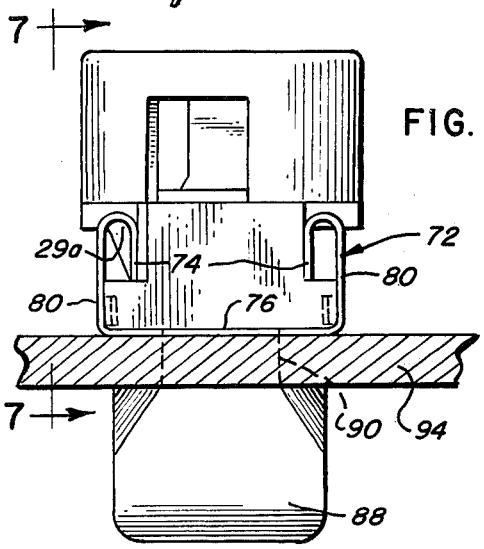
FIG. 6 is an end elevational view of the elements of FIG. 5 mounted on a panel, such as a chassis panel.
Figure 7:
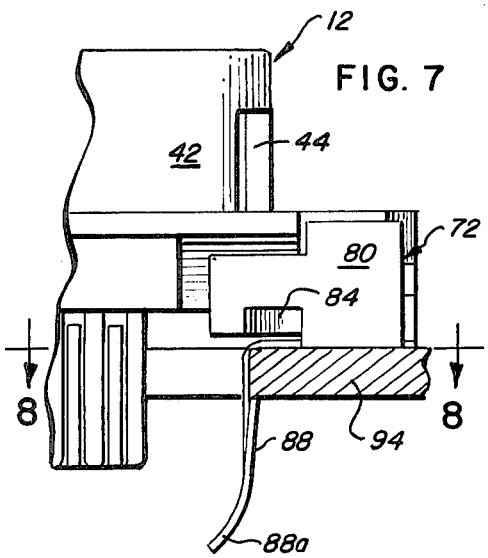
FIG. 7 is a fragmentary elevational view partly in section illustrating the assembly of FIG. 6 taken on line 7—7 of FIG. 6.
Figure 8:
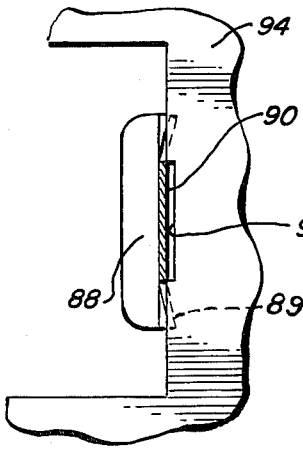
FIG. 8 is a sectional view taken on line 8—8 of FIG. 7.

It will be noted from FIGS. 6 and 8 that the portion 88 is connected to the main clip body portion mounted on the connector end by a reduced neck section 90 seen most clearly in FIG. 8. Neck 90 may be snugly received in a mating slot 92 formed in a peripheral portion of the receiving opening for the connector in the chassis support plate 94. As a result of the latter mating fit, lateral movement of the connector and clip assembly transversely to the longitudinal axis of the chassis opening in which disposed is prevented. Spring action of the clip blade 88 provides automatic engagement of the connector and clip assembly upon insertion in a panel or plate opening, and also prevents removal of the connector clip assembly from the plate 94 until the blade portions 88 of the clip are flexed inwardly to allow withdrawal of the clip blade portions from the chassis plate opening.

If discrete securing means such as screws, bolts or the like are also desired for maintaining the clip-connector assembly of FIG. 5 in assembled relationship with a mating connector, such securing means may be employed by passing through the aligned apertures **26*a* of the connector and 78 of illustrated clip 72**.

The assembly of FIG. 5 is duplicated on the left end portion of the illustrated connector so that the opposed clips provide a spring retention within the mounting chassis opening illustrated. It will be appreciated that the panel opening normally is of a length corresponding to the distance between the outer surfaces of the necks 90 of the clips. While the assembly of FIG. 5 is intended as a permanent type assembly on the connector, the clips 72 may be disengaged from the connector ends by prying the tabs 84 outwardly to allow axial sliding clip movement past the stop shoulders **31*a*** of the connector end portion.

FIGS. 9 through 12 are illustrative of mounting clips 100 adapted to be mounted on a panel, such as part of a chassis, for subsequent reception of a connector. The clips 100 typically are employed at each end of a rectangular opening in a chassis plate 94, said opening being present for reception of a connector such as illustrated plug connector 12 of FIG. 9. Each clip 100 comprises an upper planar portion 102 resting upon the upper surface of the chassis. Portion 102 is connected to and integrally formed with a bottom clip portion 104 (FIG. 12) which has an outwardly curved end portion 106 to facilitate clip-chassis engagement. Clip portions 102 and 104 are interconnected by bight portion 108 which is substantially equal to the thickness of the chassis plate 94. The interval between the clip portions 102 and 104 is such as to provide a spring clamping action to securely maintain the clip in place on a panel in the manner illustrated in FIGS. 9–12.

Referring once again to FIG. 9, it will be noted the each clip 100 possesses opposed reverse bend portions 110 defining terminal ends of opposed clip side walls 112. The innermost portion of each clip side wall 112 comprises a lead-in portion 114 which serves to provide alignment for the opposed connector ears **24*a* and 25*a* prior to axial movement thereof as described below. Such extensions thus facilitate slidable movement of the latter ears into slots 116 (FIG. 9) beneath the distal ends of the reverse bends 110** of the clip.

Figure 10:
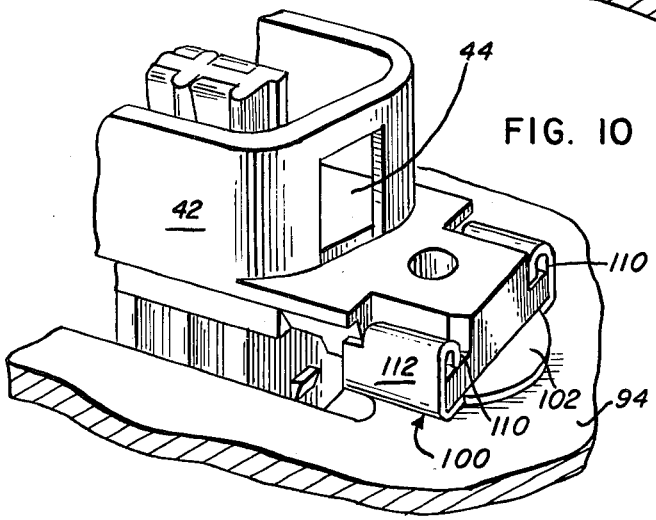
FIG. 10 is a fragmentary perspective view illustrating the right connector end portion of FIG. 9 in interengagement with the right clip member of FIG. 9.
Figure 11:
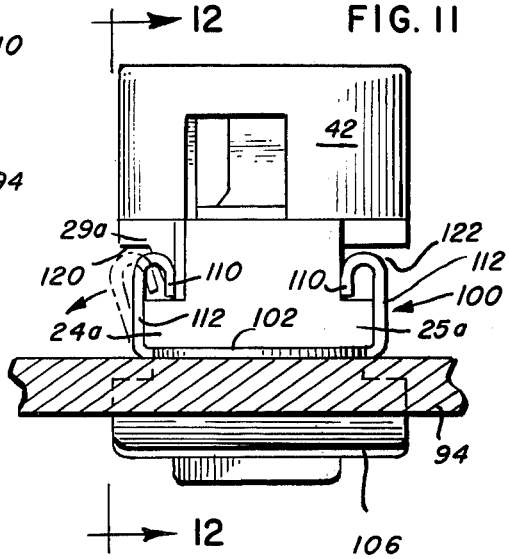
FIG. 11 is an end elevational view of the assembly of FIG. 10.
Figure 12:
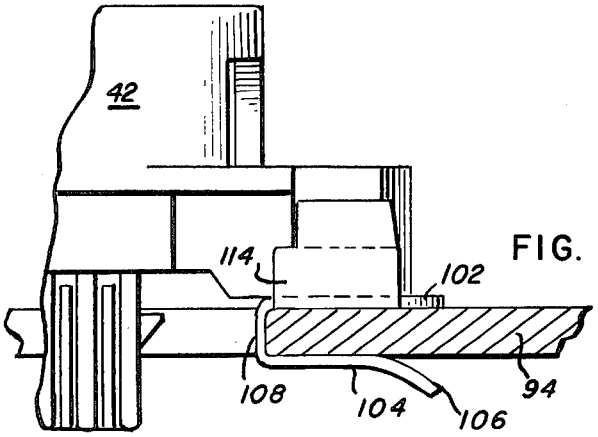
FIG. 12 is a side elevational view taken on line 12—12 of FIG. 11.

Diagonal corner portions of the connector 12 are of similar construction. It will be noted from FIG. 9 that a recess 120 is disposed in connector 12 beside ramp **30*a*. A similar recess and ramp are adjacent ear 24*a* on the diagonally opposite corner. A rectangular recess 122 is provided inwardly of each ear 25*a* as shown at the left rear corner portion of connector 12 shown in FIG. 9. The recesses 122 thus are directly opposite recesses 120, see FIG. 11. As best seen in FIGS. 11 and 12, each of these recesses 120 and 122 is of a vertical depth to accommodate the side wall portions 112 when the connector is seated on the base portions 102 of the clips 72. The depth of the slots 116 corresponds generally to the thickness of the ears 24a and 25a, as seen in FIGS. 10 and 11**.

In the normal course of assembly, a pair of clips 100 are mounted on a panel with the inner edges of the portions 110 thereof spaced apart a distance approximately equal to the length of a connector between the surfaces 29a. The connector is positioned over the spaced clips 100 with one pair of the opposed recesses 120–122 aligned with the side walls of one clip and the opposite outer end of the connector over the portions 114 of the other clip in the manner illustrated in FIG. 9. The connector then is lowered as indicated by the phantom lines so that the right ear portions 24a and 25a of the illustrated connector 12 are received between the clip lead-in portions 114 and the bottom surfaces of the ears 24a and 25a are level with the surfaces of clip portions 102. Simultaneously the sides of the opposite clip enter the respective aligned recesses 120 and 122 at the other end of the connector. One of the reverse bend portions 110 engages the inclined surface of the respective ramp 30a (at the right rear in FIG. 9) whereby the side walls of that clip will be spread outwardly in the manner illustrated by the phantom line displacement in FIG. 11. The outwardly inclined ramp 30a thus functions as a wedge spreading outwardly the clip reverse bend portion 110.

Figure 9:
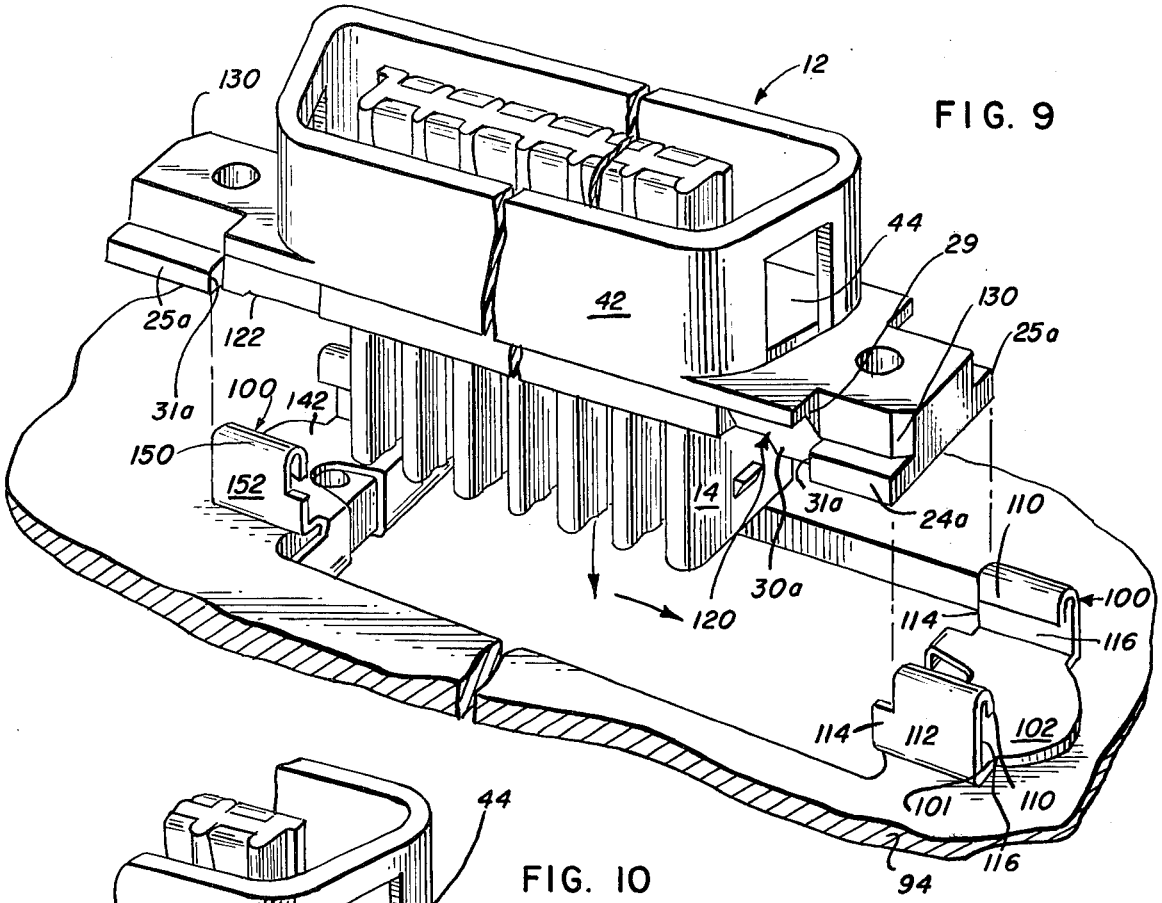
FIG. 9 is a perspective view illustrating clips mounted on the periphery of a chassis opening in accordance with teachings of this invention.

In the lowered disposition, the connector 12 then is moved axially, to the right in FIG. 9, so that both sets of opposed ears 24a and 25a slidably move beneath the terminal ends of the reverse bend portions 110 of the two clips 100, into the slots 116. The rear reverse bend clip portion 110 which was wedged outwardly by the engaged inclined ramp 30a will snap behind the respective shoulder 29a as the corresponding shoulder 29a at the opposite end abuts the respective portion 110 of the other clip. Accordingly, the noted clip reverse bend portions will function as stops abutting such shoulders 29a, and thereby will prevent the connector from moving axially left or right (as seen in FIG. 9) relative to the clips 102 and the supporting chassis plate 94. Engagement of the ears 24a and 25a beneath the ends of the bend portions 110 precludes vertical removal of the connector.

To effect disengagement between the illustrated connector and clip members of FIGS. 9–12 all that need be done is wedge either of the reverse bend portions of the illustrated clips 102 disposed adjacent an inclined ramp portion 30a of the connector 12 outward in the manner illustrated in dotted lines in FIG. 11. Thereafter the connector may be moved longitudinally past the stop shoulder 29a until the tabs 24a and 25a are clear of the reverse bend portions of the clips, thereby allowing ready separation of the connector from the clips and chassis.

Although the connector 12 of FIG. 9 possesses two ramps at opposite connector ends which allow clip engagement or disengagement regardless of the direction of connector axial movement, the illustrated clip connector combination will work to advantage with three and four connector ramps.

It will be noted from FIG. 9 that connector corner portions 130 (only one being seen) are beveled for the operator to readily identify the location of the ramp portions 30a. If, however, there is a ramp adjacent each connector ear i.e., the connector has four ramps, the bevels would, of course, be unnecessary. A connector recess 122 disposed on the right rear connector portion not illustrated in FIG. 9, is visible in the end view comprising FIG. 11.

Figure 13:
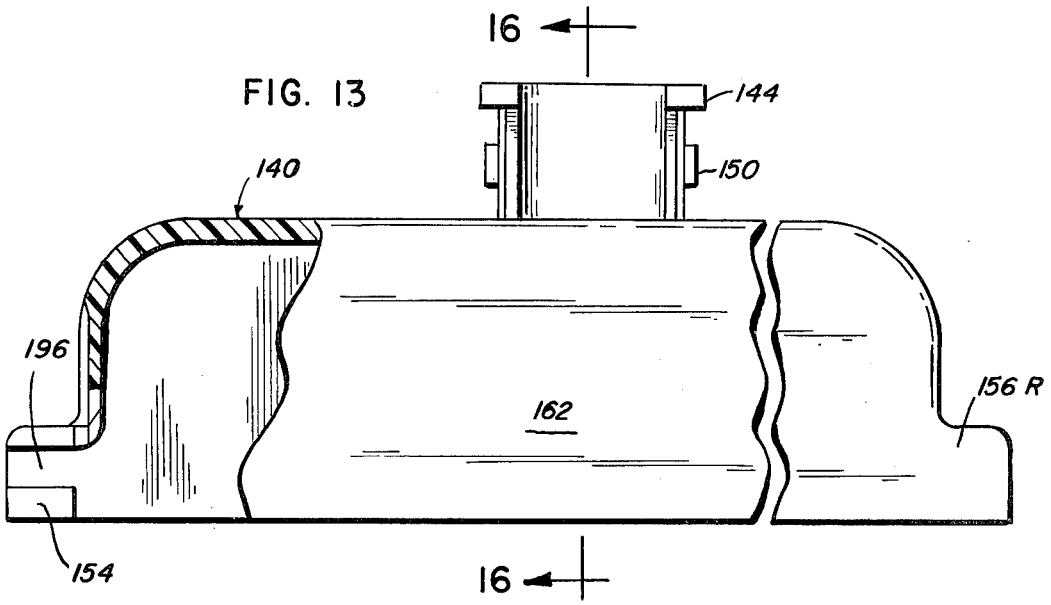
FIG. 13 is a fragmentary elevational view, partly in section, of a connector hood adapted to engage connector members illustrated in various views of the drawing, and employing teachings of this invention.

The provided connector constructions having the predeterminately formed end portions may engage hood members such as hood 140 of FIG. 13 and hood 142 of FIG. 18 in the same general manner as just described for engagement with a pair of clips 100. In the illustrated hood 140 a strain relief entranceway 144 is disposed in a top portion of the hood. The strain relief or cable entranceway may also be disposed in a hood end wall as is well known in the art and shown in FIG. 18. Such hoods are used to cover the contact sides of the connector after wires are terminated in the contacts, and normally are used in the field when the connectors are not secured to mounting panels.

Figure 17:
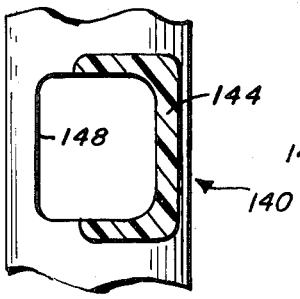
FIG. 17 is a sectional view taken on line 17—17 of FIG. 16.
Figure 16:
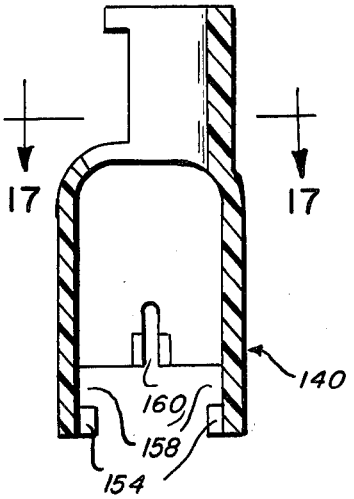
FIG. 16 is a sectional view taken on line 16—16 in FIG. 13.

It will be seen from the sectional views comprising FIGS. 16 and 17 that cable entranceway 144 has an open side, facilitating a secure locking engagement with a cable (not illustrated) disposed in the opening 148 in the top portion of hood 140 through which a cable passes. Locking means 150 engages a flexible strap or the like (not illustrated) which may be employed for purposes of securing a cable to the periphery of the strain relief entranceway 144, said periphery being shown in section in FIG. 17.

Figure 14:
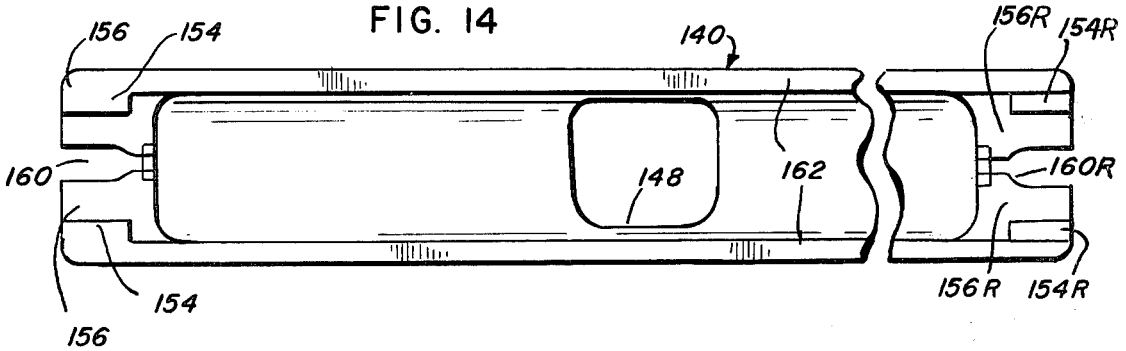
FIG. 14 is a bottom plan view of the hood of FIG. 13.
Figure 15:
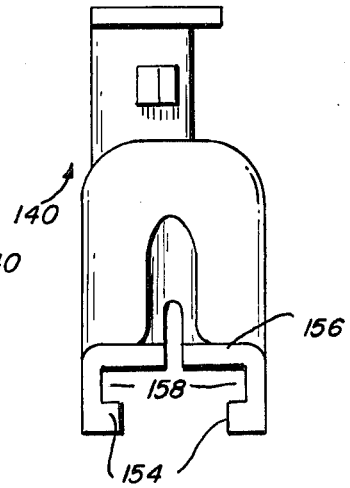
FIG. 15 is an end elevational view of the hood member of FIG. 13.

Opposed inwardly disposed foot portions 154 are formed integrally with the lower edges of split end portions 156 of the hood 140. It will be seen from the elevational view comprising FIG. 15 that these opposed foot portions define opposed slots or channels 158 in which connector ears such as ears 24a and 25a of connector 12 illustrated in FIG. 17 may be slidably received. Referring also to FIG. 14, split rear end portions 156R of hood 140 have similar slot-defining guide foot portions 154R. Because the slots 160 and 160R split the end hood portions, the split hood portions 156 and 156R carrying the opposed feet 154 and 154R respectively may be resiliently urged apart. Accordingly, a connector such as connector 10 or connector 12 illustrated herein may assume a joining relationship relative to the foot portions 154 and 154R of the hood 140 the same as above described in conjunction with the prepositioned mounting clips 100 of FIGS. 9 through 12.

Thus connector 12 illustrated in FIG. 9 is adapted to be snugly received between opposed side walls 162 of hood 140. In the course of interconnecting a hood 140 with the connector, one pair of the connector ears 24a and 25a are disposed exteriorly of the hood and adjacent to the foot portions 154 or the rear foot portions 154R, and with the adjacent feet being received in the respective opposed recesses 120 and 122. The other pair of connector ears 24a and 25a are disposed interiorly of the hood between the side walls 162 and adjacent the other pair of the channel-defining foot portions of the hood. In the course of this initial joining movement, the respective tapered ramp 30a disposed on the connector 12 functions to wedge the engaged channel-defining foot portions 154 or 154R of the hood apart, thereby allowing the cammed foot portion to move past the stop shoulder 29a of the connector. The hood is also axially moved so that the two pairs of connector ear portions 24a and 25a interfit in the channels defined by the foot portions 154 and 154R. The foot portions thus become locked on opposite sides of the end stop faces 29a of the tapered ramps 30a. To this end, the inwardly facing end surfaces of the pairs of foot portions 154 and 154R are spaced apart a distance approximating the axial dimension of the connector between the shoulders 29a. Also, the lower portion of the hood, between the two pairs of feet 154–154R, is of sufficient width to admit a connector and its end portions as described.

To effect a release between hood 140 and a connector, all that need be done is outwardly pry one of the flexibly mounted foot portions 154 and 154R until the stop shoulder 29a defined by inclined ramp 30a may be surmounted whereafter an axial movement frees the hood from interlocking engagement with the connector.

FIGS. 18 through 23 illustrate a modified hood 142 which differs from hood 140 by having a strain relief entranceway 146 disposed at the hood rear end. Entranceway 146 although located differently relative to the main hood body is similar to entranceway 144 having an open side and locking means 152 as seen in FIGS. 21 and 18 respectively.

Hood 142 further differs from hood 140 in that foot portions 156 of defining receiving slots 158 (see FIG. 23) for connector ears are integrally formed with opposed connector wall portions 160 which are rigid and not resiliently movable relative to each other. However, rear foot portions 162 are integrally formed with hood wall portions 164 (see FIGS. 28, 30) which may be resiliently spread apart to engage a connector ramp as a connector is engaged in the manner described relative to hood 140.

However, since the hood 142 may only spread apart at its "strain relief" end, the hood 142 must be placed relative to a connector to be engaged so that the smaller hood end with the hood foot portions 156 is spaced from ears 25 or 25a of a connector (such as connectors 11 and 12) about ¼ inch. The foot portions 162 are then slid down into the connector recesses such as recesses 120 and 122 of connector 12 of FIG. 9 with at least one adjacent ramp 30a serving to spread the hood walls 164 apart. Hood 142 is then slid longitudinally so that connector ears enter channels 158 (see FIG. 23) at the hood front end as one or both foot portions 162 snap off the one (or two) inclined ramps disposed at the opposed connector end. The hood will then be prevented from moving axially to the right in FIG. 18 by means of solid connector end 170 (see FIGS. 18 and 19) and prevented from axially moving to the left by one (or two) stop shoulders such as shoulder 29a in FIG. 9.

Hood 142 is less flexible in use than hood 140 requiring slidable axial movement in the same direction (to the right in FIG. 9) during connector engagement and in the same direction (to the left in FIG. 9) when the hood is disengaged from an engaged connector.

To disengage hood 142 from a connector, one or both rear walls 164 are spread outwardly sufficiently so that one or both foot portions 162 may clear the adjacent stop shoulder 29a permitting slidable movement of the hood (to the left in FIG. 9) until the hood is disengaged from the connector.

It is believed apparent from the foregoing description that significant improvements in ribbon-type electrical connectors have been disclosed. The disclosed connectors may be of a variety of sizes, and may be formed substantially entirely of plastic.

The connectors are compatible with other connectors and for joining to other connectors in a variety of ways, as described further in my copending application Ser. No. 736,942, filed October 24, 1976. Moreover, the connectors are readily connectable with a variety of mounting clips and hoods in a facile manner as described herein. The described mounting clips may be mounted either on the opposed ends of the connector construction or mounted on a chassis plate for ready engagement and disengagement with the connector without the need for discrete securing means. The same ready engagement and disengagement between the clip and connectors made possible by virtue of novel inclined ramps and locking shoulders integrally formed with opposed end portions of the connector may be employed for purposes of effecting ready engagement and disengagement with a protective hood for the disclosed connectors.

It is believed apparent from the foregoing that a variety of constructions have been provided which, although simple in structural detail, are efficient in use. It is also believed apparent that a large number of modifications may be made in the structures above disclosed, and this invention is to be limited therefore only by the scope of the appended claims.

What is claimed is:

1. In a ribbon connector assembly, the combination comprising a connector body of electrically insulating plastic having a plurality of wire-engaging contacts mounted therein, a member with which said connector is adapted to assume a fixed positional relation, and means for joining said connector body to said member; said connector body having opposed longitudinal end portions of lesser height than an interposed body portion in which said contacts are mounted; distal corners of each of said connector end portions being relieved to provide opposed lateral mounting ears and opposed abutment shoulders disposed inwardly of the connector distal ends adjacent the inner ends of said ears; said joining means including spaced interlock elements for simultaneously slidably engaging each of said ears and for subsequently abutting said abutment shoulders to interlockingly engage said connector for attachment of said connector to said member with which said means are joined.

2. In a ribbon connector assembly, the combination comprising a connector body of electrically insulating plastic having a plurality of wire-engaging contacts mounted therein, a member with which said connector is adapted to assume a fixed positional relation, and means for joining said connector body to said member; said connector body having opposed longitudinal end portions extending from an interposed body portion in which said contacts are mounted; each of said connector end portions having opposed laterally projecting ears and opposed abutment shoulders disposed inwardly of the connector distal ends adjacent the inner ends of said ears; said joining means including spaced interlock elements for simultaneously slidably engaging each of said ears and for abutting said abutment shoulders to interlockingly engage said connector for attachment of said connector to said member with which said means are joined; said member comprising a hood adapted to cover the connector wire-engaging contacts when joined to said connector by such joining means integrally formed with said hood.

3. In a ribbon connector assembly, the combination comprising a connector body of electrically insulating plastic having a plurality of wire-engaging contacts mounted therein, a member with which said connector is adapted to assume a fixed positional relation, and means for joining said connector body to said member; said connector body having opposed longitudinal end portions extending from an interposed body portion in which said contacts are mounted; each of said connector end portions having opposed laterally projecting ears and opposed abutment shoulders disposed inwardly of the connector distal ends adjacent the inner ends of said ears; said joining means including spaced interlock elements for slidably engaging each of said ears and for abutting said abutment shoulders to interlockingly engage said connector for attachment of said connector to said member with which said means are joined; each of said interlock elements comprising a clip having opposed wall portions formed to define slots adapted to receive said connector ears therein; each of said clips also having resilient projecting means whereby a connector having clips mounted on opposed connector ends may be resiliently mounted in an opening of a mounting chassis in which said clip projecting means resiliently engage opposed portions of the periphery of said opening.

4. The assembly of claim 3 in which each of said clips has a lead-in portion contiguous with each wall portion and adapted to guide the ears of a connector into said clip slots, and inwardly directed spring tabs formed from each of said lead-in portion directed toward the opposed clip wall portion, and engaging an inner end of a connector ear when said ears are disposed in said clip slots.

5. The assembly of claim 3 in which a clip base portion interconnects said clip wall portions of each clip and is integrally formed with said resilient projecting means adapted to mount said clip on the edge of a member comprising a mounting panel or the like.

6. In a ribbon connector assembly, the combination comprising a ribbon connector having opposed end portions for interfitting with opposed wall portions of a second means adapted to be assembled with said connector in the absence of discrete securing means; said connector having on each end portion laterally projecting interconnecting means; second means adapted to be assembled in a fixed relation with said connector and having opposed walls defining in part slots; said slots being adapted to receive said connector laterally projecting interconnecting means; said connector including recesses disposed adjacent the inner ends of said interconnecting means and including sloping cam surfaces therein; an abutment surface defining the outer end limit of each of said connector cam surfaces; the inner end edges of the interconnecting means defining transverse surfaces; the inner end of one of said interconnecting means on each connector end portion terminating in substantially the plane of one of said abutment surfaces; said opposed walls of said second means being relatively resiliently movable; whereby said walls of said second means may move over said cam surfaces and assume a first position wherein relative axial movement between said connector and said second means results in assembly of said connector with said second means by reception of said interconnecting means in the slots of said second means, at least one of the resilient movable walls of said second means being cammed outwardly by said connector cam surface in said first position.

7. In a ribbon connector and mounting clip assembly the combination comprising a connector body of electrically insulating plastic having a plurality of wire-engaging contacts mounted therein; said body having opposed longitudinal end portions extending from a central body portion in which said contacts are mounted; each of said connector end portions having laterally projecting ear portions adapted to engage portions of said mounting clip thereon; said connector having a cam surface disposed adjacent the inner end of one of said ears; said clip having opposed reverse bend side wall portions interconnected by a clip base; said reverse bend portions terminating in spaced relation with said base so as to define slots for receiving said connector ears therebetween and interlockingly engaging said connector; said cam surface being adapted to spread one of said side wall portions outwardly relative to said base when said connector cam surface is urged between said side wall portions into a position enabling said clip reverse bend portions to be axially slidably moved over said ears as said ears are received in said clip slots; said cam surface having an end wall portion disposed adjacent the inner ends of said one ear and adapted to prevent relative axial movement of said clip from the respective ear toward said cam surface.

8. A ribbon connector construction comprising a body of electrically insulating plastic having a plurality of wire-engaging contacts mounted therein; said body having opposed longitudinal end portions extending from an interposed body portion in which said contacts are disposed; each of said end portions including opposed laterally projecting ears adapted to engage a securing element of a mounting clip or the like over an upper surface thereof; said connector having a sloping side surface portion disposed adjacent the inner end of at least one of said laterally projecting ears; said sloping side surface portion extending outwardly and upwardly above the level of said upper surface of the adjacent connector ear; the outer end of said sloping connector surface portion defining an abutment shoulder disposed above said upper surface of said adjacent connector ear for abutting engagement with a securing element positioned over said upper surface.

9. The connector construction of claim 8 in which said laterally projecting ears at each connector end portion project from a central connector portion of greater thickness; said ears being of uniform cross-section.

10. The ribbon connector of claim 8 in which one of said ears at each connector end terminates at its inner end in a stop surface disposed in substantially planar relation with an abutment shoulder.

11. The ribbon connector of claim 8 in combination with clip elements having opposed slot-defining walls; said connector ears disposed at opposed connector ends being received in the opposed slots of each of said clips; each of said clips having a projecting spring tab engageable with an adjacent ear stop shoulder when said connector ears engage said clip slots preventing slidable movement of said clips outwardly of said connector end portions; the inner end of at least one of each of said clip walls being engageable with an adjacent abutment shoulder preventing movement of said clips inwardly of said clip ends in the normal position of connector clip assembly whereby said clips are securely retained to said connector ends.

12. A ribbon connector adapted to engage mounting clips or the like at opposed ends thereof comprising a body of electrically insulating plastic having a plurality of wire-engaging contacts mounted therein; said body having oppositely extending end portions; each of said end portions including two opposed laterally extending mounting ears for engaging a clip or the like, and having an outwardly facing sloping cam surface disposed adjacent at least one of said mounting ears; each of said cam portions being adapted to cam a clip element into position for engaging the respective adjacent mounting ear; and latching means adapted to engage a complementary latching means of another connector in interlocking engagement, integrally formed with said connector body.

13. The ribbon connector of claim 12 in which the inner end of each mounting ear defines a stop shoulder; the outer end of each of said cam surfaces being disposed adjacent an ear stop shoulder; said outer end of said sloping surface defining an abutment shoulder.

14. The ribbon connector of claim 12 in which each connector sloping surface is disposed opposite a recess formed in a lateral portion thereof; said connector body being formed at each connector end portion to visually indicate the connector side on which a sloping surface is disposed.

15. In a mounting clip for securing a ribbon connector to a chassis plate, the combination comprising opposed parallel side walls extending from an interposed clip base; terminal end portions of said side walls comprising parallel reverse bend portions terminating at a fixed interval above said clip base so as to define opposed slots for receiving end portions of a connector therebetween, whereby said mounting clip may engage such connector in a snug interlocking engagement; said slots having opposed open ends; and resilient attachment means connected to said clip base for detachably securing said clip to an opening-defining peripheral portion of a chassis plate or the like.

16. The clip of claim 15 in which at least one of said clip side walls is resiliently connected to said clip base whereby said side wall and the reverse bend portion integrally formed therefrom may pivot outwardly about the juncture of said side with said clip base.

17. The clip of claim 15 in which said clip side walls have extensions contiguous with said side wall portions from which said reverse bend portions are formed; said extensions being adapted to guide connector end portions to be received in the clip slots between said clip reverse bend portions.

18. The clip of claim 17 in which inwardly directed resilient tabs are cut from said side wall extensions; said tabs having distal ends terminating at substantially an adjacent end of the clip connector-receiving slots.

19. The combination of a hood construction for a ribbon connector comprising a main body portion having opposite end portions, each of said end portions having opposed side wall portions resiliently movable laterally relative to each other; each side wall portion having an inwardly projecting, channel-defining foot portion opposed to the foot portion of the opposed side wall portion; the opposed foot portions at each hood end portion defining a slot for reception of a connector end portion therein; the slots disposed in said hood opposite end portions being in axial alignment; and a ribbon connector comprising a body of electrically insulating plastic having a plurality of wire-engaging contacts mounted therein and having opposite end portions; each of said end portions having laterally extending ears adapted to be snugly received in the slots disposed in the opposed hood end portions; a cam surface disposed on said connector body adjacent the inner end of one of said ears; said cam surface being adapted to outwardly flex one hood side wall and one foot portion when said one foot portion is urged at right angles against said cam surface with said connector and hood central longitudinal axes in substantial superposed arrangement.

20. A method for mounting an element having opposed resilient slot-defining wall portions to opposed laterally projecting ears of a ribbon connector adapted to be received in the slots defined by said resilient wall portions in interlocking relation, said connector also having an inclined surface disposed adjacent one end of one of said ears and an abutment surface preventing an axial slidable disengagement of said wall portions from said one end of said ears; the steps comprising urging said resilient wall portions into straddling relation with said connector at said inclined surface whereby one of said resilient wall portions is flexed outwardly by said inclined surface, and axially moving said element over said connector ears whereby said ears are received in said slots and said one wall portion snaps from engagement with said inclined surface into position to abut said abutment surface.

21. A method for interfitting a connector body having laterally projecting ears at opposed end portions to spaced slotted means having a fixed interval therebetween, said interval being substantially defined by abutment surfaces disposed on opposed connector portions; said slotted means being adapted to engage the ears at opposed connector ends by means of such slots; said connector having a cam surface adjacent the inner end of one of said ears and said slotted means having opposed wall portions which are laterally resiliently movable, the steps comprising wedging a resiliently movable wall portion of one of said slotted means apart by urging the same against said connector cam surface, and axially sliding said connector ears into engagement with said slotted means with said resiliently movable wall portion in the wedged apart condition effected by said connector cam surface until one connector abutment surface engages the end of a wall portion of the slotted means oppositely disposed to said one slotted means, and the resilient wedged apart wall portion of said one slotted means leaves contact with said cam surface.

22. In a ribbon connector assembly, the combination comprising a connector body of electrically insulating plastic having a plurality of wire-engaging contacts mounted therein, a member with which said connector is adapted to assume a fixed positional relation, and means for joining said connector body to said member; said connector body having opposed longitudinal end portions extending from an interposed body portion in which said contacts are mounted; each of said connector end portions having opposed laterally projecting ears and opposed abutment shoulders disposed inwardly of the connector distal ends adjacent the inner ends of said ears; said joining means including spaced interlock elements for slidably engaging each of said ears and for abutting said abutment shoulders to interlockingly engage said connector for attachment of said connector to said member with which said means are joined; at least one of said abutment shoulders defining the end of a sloping ramp portion formed in said connector adjacent the inner end of one of said connector ears.

23. In a ribbon connector assembly, the combination comprising a connector body of electrically insulating plastic having a plurality of wire-engaging contacts mounted therein, a member with which said connector is adapted to assume a fixed positional relation, and means for joining said connector body to said member; said connector body having opposed longitudinal end portions extending from an interposed body portion in which said contacts are mounted; each of said connector end portions having opposed laterally projecting ears and opposed abutment shoulders disposed inwardly of the connector distal ends adjacent the inner ends of said ears; said joining means including spaced interlock elements for simultaneously slidably engaging each of said ears and for subsequently abutting said abutment shoulders to interlockingly engage said connector for attachment of said connector to said member with which said means are joined; each abutment shoulder and the inner end limit of an adjacent ear lying in substantially the same plane.

24. In a ribbon connector assembly, the combination comprising a connector body of electrically insulating plastic having a plurality of wire-engaging contacts mounted therein, a member with which said connector is adapted to assume a fixed positional relation, and means for joining said connector body to said member; said connector body having opposed longitudinal end portions extending from an interposed body portion in which said contacts are mounted; each of said connector end portions having opposed laterally projecting ears and opposed abutment shoulders disposed inwardly of the connector distal ends adjacent the inner ends of said ears; said joining means including spaced interlock elements for slidably engaging each of said ears and for abutting said abutment shoulders to interlockingly engage said connector for attachment of said connector to said member with which said means are joined; each of said interlock elements comprising a clip having opposed wall portions defining slots adapted to receive said connector ears therein, a base portion interconnecting said wall portions and resilient mounting means integrally formed with said base portion adapted to mount said clip on the periphery of a member such as a mounting panel or the like.

25. The connector assembly of claim 24 in which said clip walls and said slots therein are substantially coextensive with said connector ears, and an inclined wedging surface is formed on said connector on each of said opposed ends adjacent the inner end of at least one of said ears; said clip walls being resiliently connected to clip base portions thereof whereby said clip walls may be wedged apart by said connector wedging surface allowing relative slidable movement between said connector and clip so that said clip may move over the abutment shoulder adjacent said clip and said connector ears may be received in said clip wall slots.

26. In a ribbon connector assembly, the combination comprising a connector body of electrically insulating plastic having a plurality of wire-engaging contacts mounted therein, a member with which said connector is adapted to assume a fixed positional relation, and means for joining said connector body to said member; said connector body having opposed longitudinal end portions of lesser height than an interposed body portion in which said contacts are mounted; distal corners of each of said connector end portions being relieved to provide opposed lateral mounting ears and opposed abutment shoulders inwardly of the connector distal ends adjacent the inner ends of said ears; said joining means comprising a pair of clips for engaging edge portions of an opening in a chassis comprising said member; said clips having resilient engagement portions for receiving end portions of said connector therebeneath in an interfitting engagement.

27. A ribbon assembly as in claim 26 wherein each of said clips has a resilient clamp portion connected to said reverse bend portions for engaging such an edge portion of said chassis on which mounted.

28. In a ribbon connector assembly, the combination comprising a connector body of electrically insulating plastic having a plurality of wire-engaging contacts mounted therein, a member with which said connector is adapted to assume a fixed positional relation, and means for joining said connector body to said member; said connector body having opposed longitudinal end portions of lesser height than an interposed body portion in which said contacts are mounted; distal edge portions of each of said connector end portions providing plural engagement surfaces for engagement by such joining means; said joining means comprising a pair of clips engaged on edge portions of an opening in a chassis comprising said member; said clips having resilient engagement portions for receiving said connector end portions while said clips are so engaged on a chassis and engaging said engagement surfaces for locating and retaining said connector on such a chassis.

29. A ribbon assembly as in claim 28 wherein said engagement portions of each of said clips includes a reverse bend portion for engaging over said end portions.

* * * * *